US011511563B2

(12) United States Patent
Lee

(10) Patent No.: US 11,511,563 B2
(45) Date of Patent: Nov. 29, 2022

(54) BINDER ADAPTED PALETTE

(71) Applicant: Pluspress Co., Ltd, Incheon (KR)

(72) Inventor: Young Ji Lee, Incheon (KR)

(73) Assignee: Pluspress Co., Ltd, Incheon (KR)

( * ) Notice: Subject to any disclaimer, the term of this patent is extended or adjusted under 35 U.S.C. 154(b) by 0 days.

(21) Appl. No.: 17/633,017

(22) PCT Filed: Jun. 8, 2020

(86) PCT No.: PCT/KR2020/007394
§ 371 (c)(1),
(2) Date: Feb. 4, 2022

(87) PCT Pub. No.: WO2021/025277
PCT Pub. Date: Feb. 11, 2021

(65) Prior Publication Data

US 2022/0266623 A1 Aug. 25, 2022

(30) Foreign Application Priority Data

Aug. 5, 2019 (KR) ..... 10-2019-0095009
Jun. 5, 2020 (KR) ..... 10-2020-0068511

(51) Int. Cl.
*B44D 3/02* (2006.01)
*B42F 13/16* (2006.01)

(52) U.S. Cl.
CPC ..... *B44D 3/02* (2013.01); *B42F 13/16* (2013.01); *B42P 2241/16* (2013.01)

(58) Field of Classification Search
CPC ... B44D 3/02; B44D 3/04; B42F 13/16; B42P 2241/16
USPC ..... 206/1.8, 1.7, 1.9; 402/4
See application file for complete search history.

(56) References Cited

U.S. PATENT DOCUMENTS 1,699,388 A * 1/1929 Beindorff ..... B44D 3/04 312/333
3,389,945 A * 6/1968 Thomas ..... B44D 3/04 312/231
4,149,628 A * 4/1979 Gabarro ..... B44D 3/04 206/557

(Continued)

FOREIGN PATENT DOCUMENTS

JP 2002-282042 A 10/2002
KR 20-2009-0011200 U 11/2009

(Continued)

OTHER PUBLICATIONS

KR Grant of Patent for 10-2020-0068511, dated Nov. 26, 2021.

(Continued)

*Primary Examiner* — Steven A. Reynolds
(74) *Attorney, Agent, or Firm* — Sughrue Mion, PLLC

(57) ABSTRACT

Disclosed is a binder adapted palette that is easily attached or detached to or from a diary or notebook binder and thus is easily stored and carried together with the binder. The binder adapted palette includes a body having a palette accommodation groove defined in a top surface thereof and a plurality of through-holes defined and arranged along one edge thereof, wherein the plurality of through-holes receive a binder ring of the binder; a palette detachably inserted into the palette accommodation groove; and a cover coupled to a top of the body to open and close the palette.

4 Claims, 10 Drawing Sheets

(56) References Cited

U.S. PATENT DOCUMENTS

| | | | | | |
|---|---|---|---|---|---|
| 4,765,457 | A * | 8/1988 | Rayhle | B44D 3/04 | 206/372 |
| 5,036,973 | A * | 8/1991 | Aida | B42D 5/006 | 281/31 |
| 5,257,721 | A * | 11/1993 | Smith | B44D 3/04 | 220/831 |
| 5,325,958 | A * | 7/1994 | Arasim | B44D 3/04 | 206/1.7 |
| 6,382,421 | B1 * | 5/2002 | Dao | A45C 11/36 | 206/371 |
| 2008/0156667 | A1 * | 7/2008 | Huggins | B44D 3/02 | 248/163.1 |
| 2008/0302383 | A1 * | 12/2008 | de Montjamont | B44D 3/04 | 132/316 |
| 2018/0086132 | A1 * | 3/2018 | Moore | B42F 13/0026 | |
| 2018/0264876 | A1 * | 9/2018 | Davis | B44D 3/04 | |

FOREIGN PATENT DOCUMENTS

| | | |
|---|---|---|
| KR | 10-1252436 B1 | 4/2013 |
| KR | 20-0480640 Y1 | 6/2016 |

OTHER PUBLICATIONS

KR Notification of Reason for Refusal for 10-2020-0068511, dated May 25, 2021.
International Search Report for PCT/KR2020/007394, dated Sep. 17, 2020.

* cited by examiner

【FIG. 1】
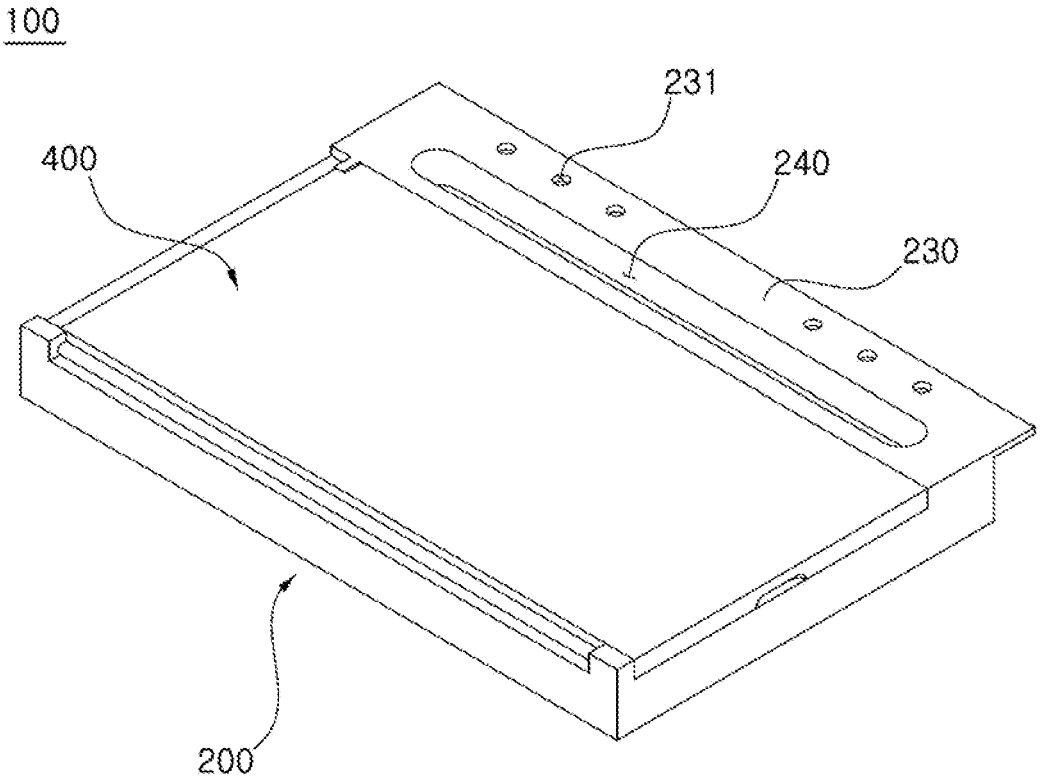

【FIG. 2】
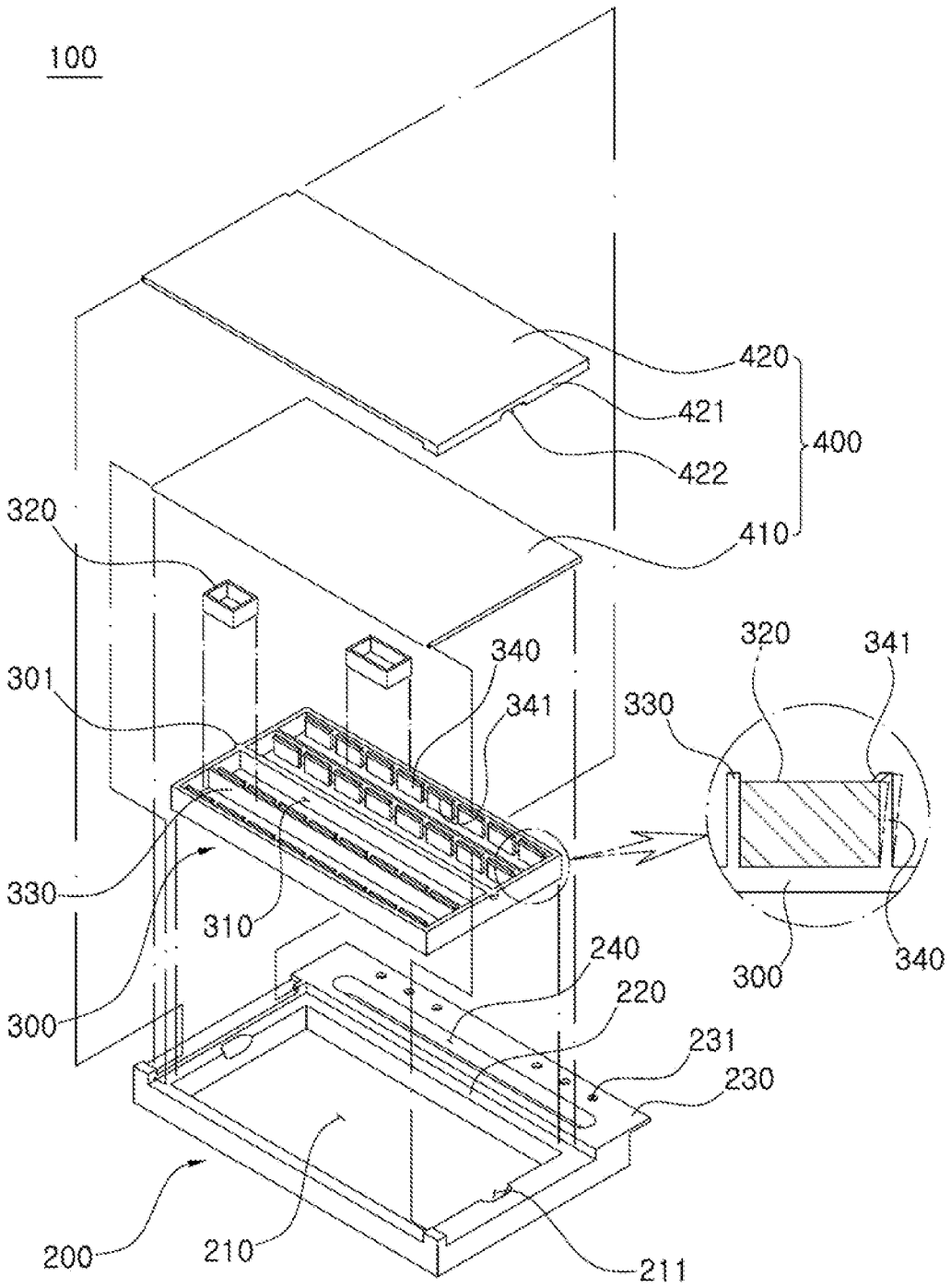

【FIG. 3】
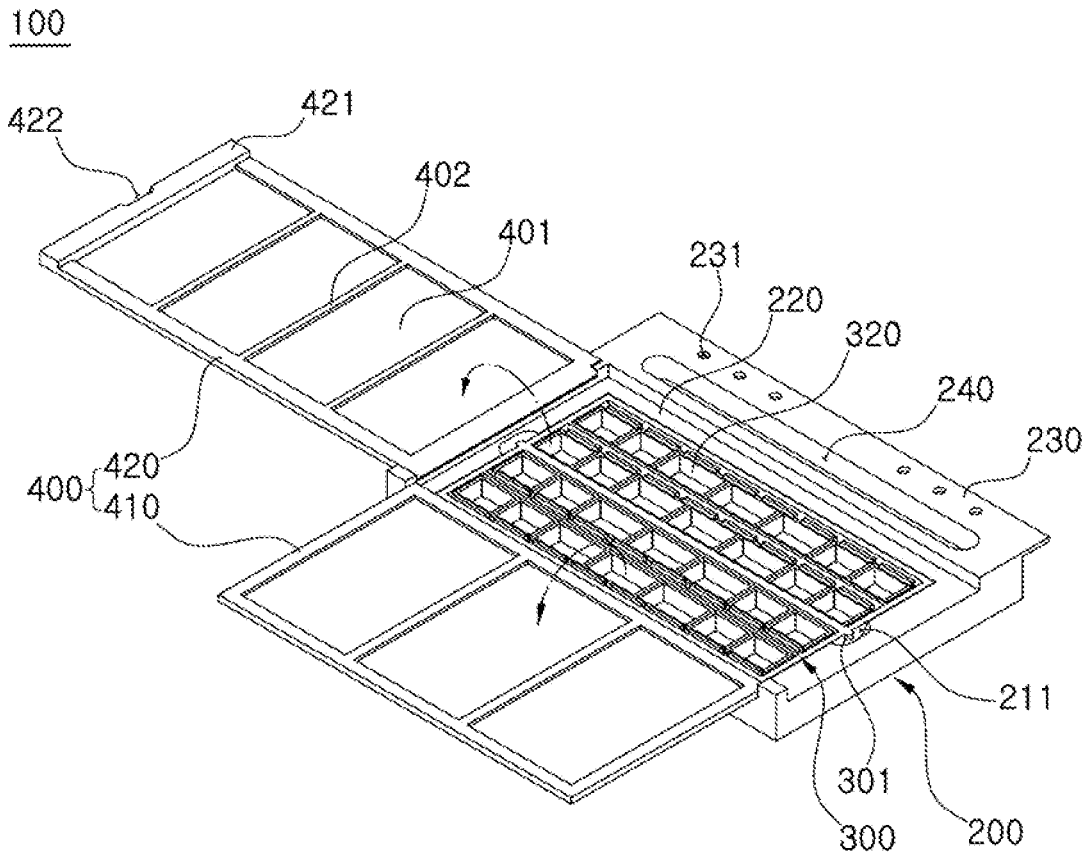

【FIG. 4】
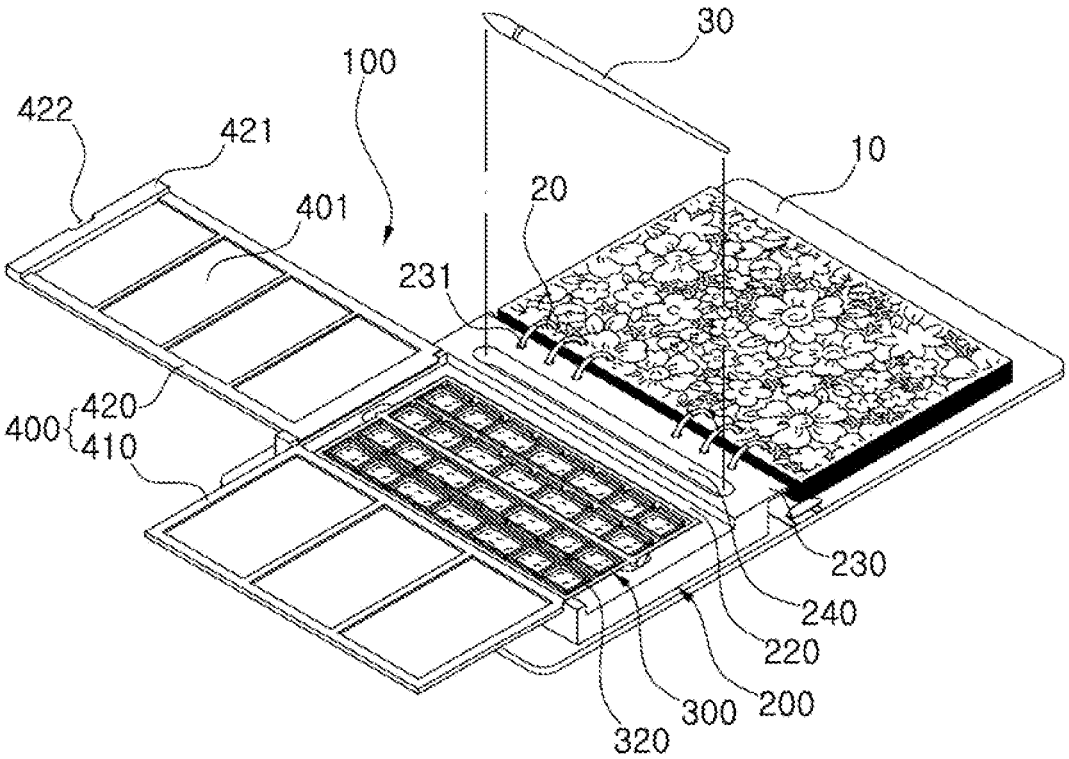

【FIG. 5】
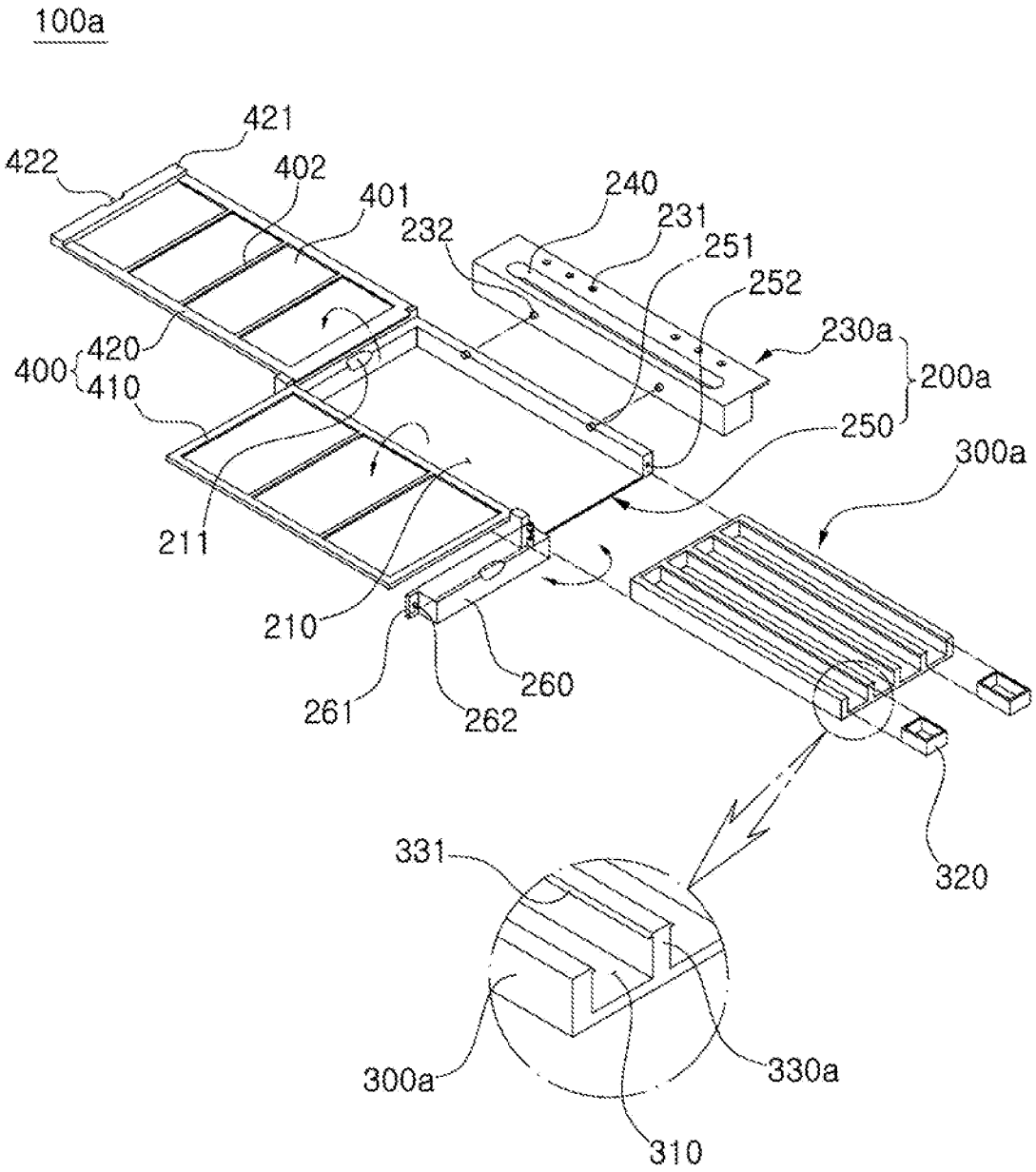

【FIG. 6】
100a
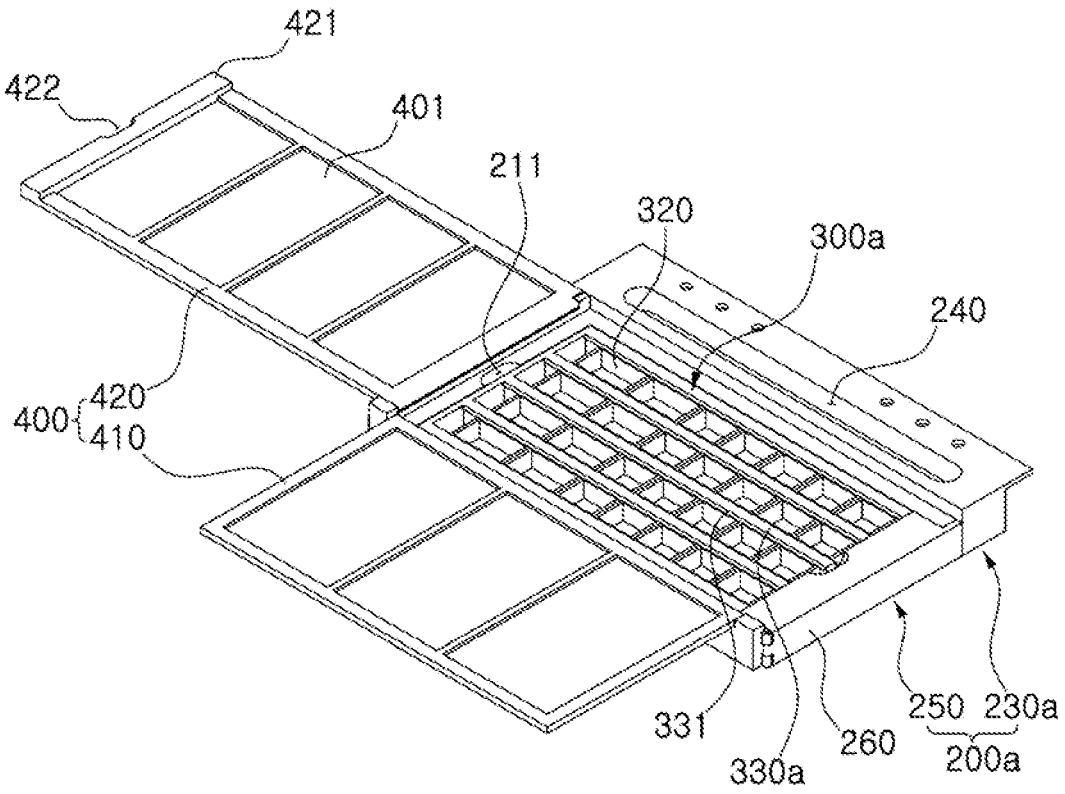

【FIG. 7】
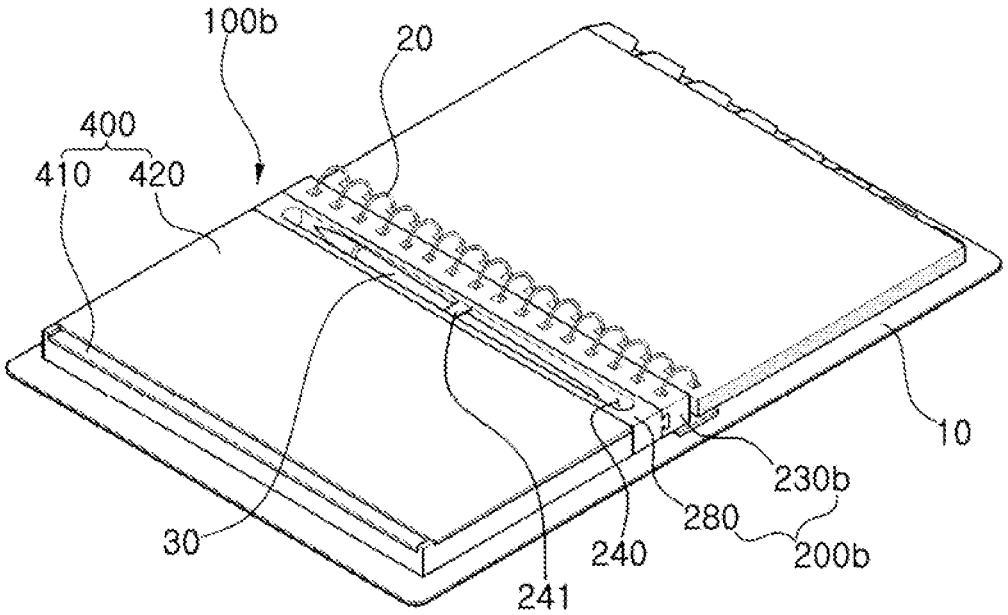

【FIG. 8】
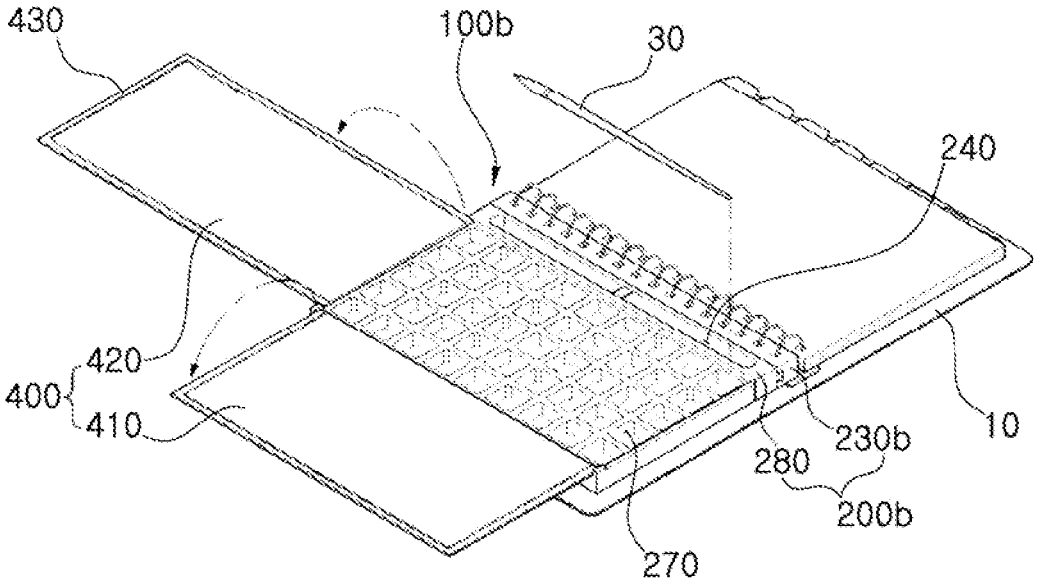

【FIG. 9】
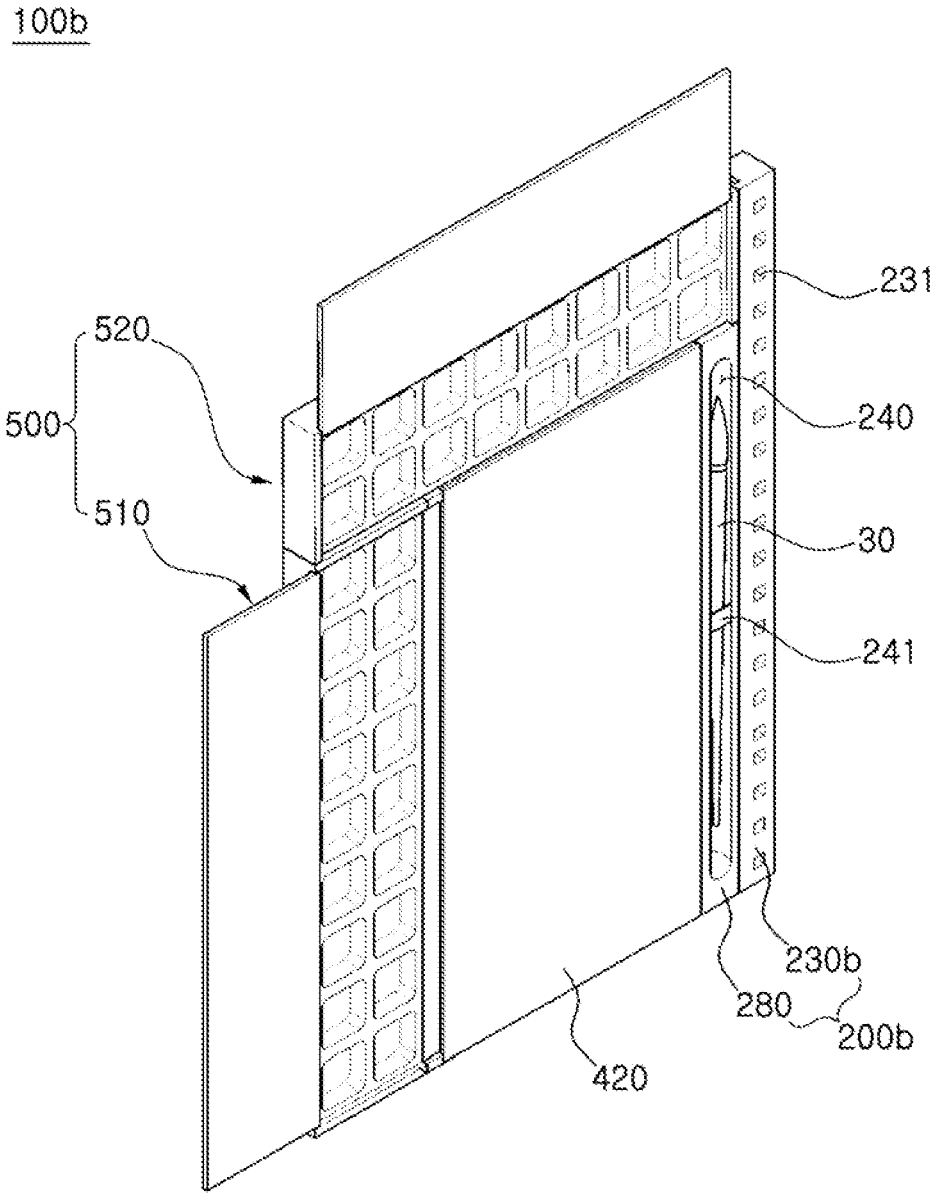

【FIG. 10】
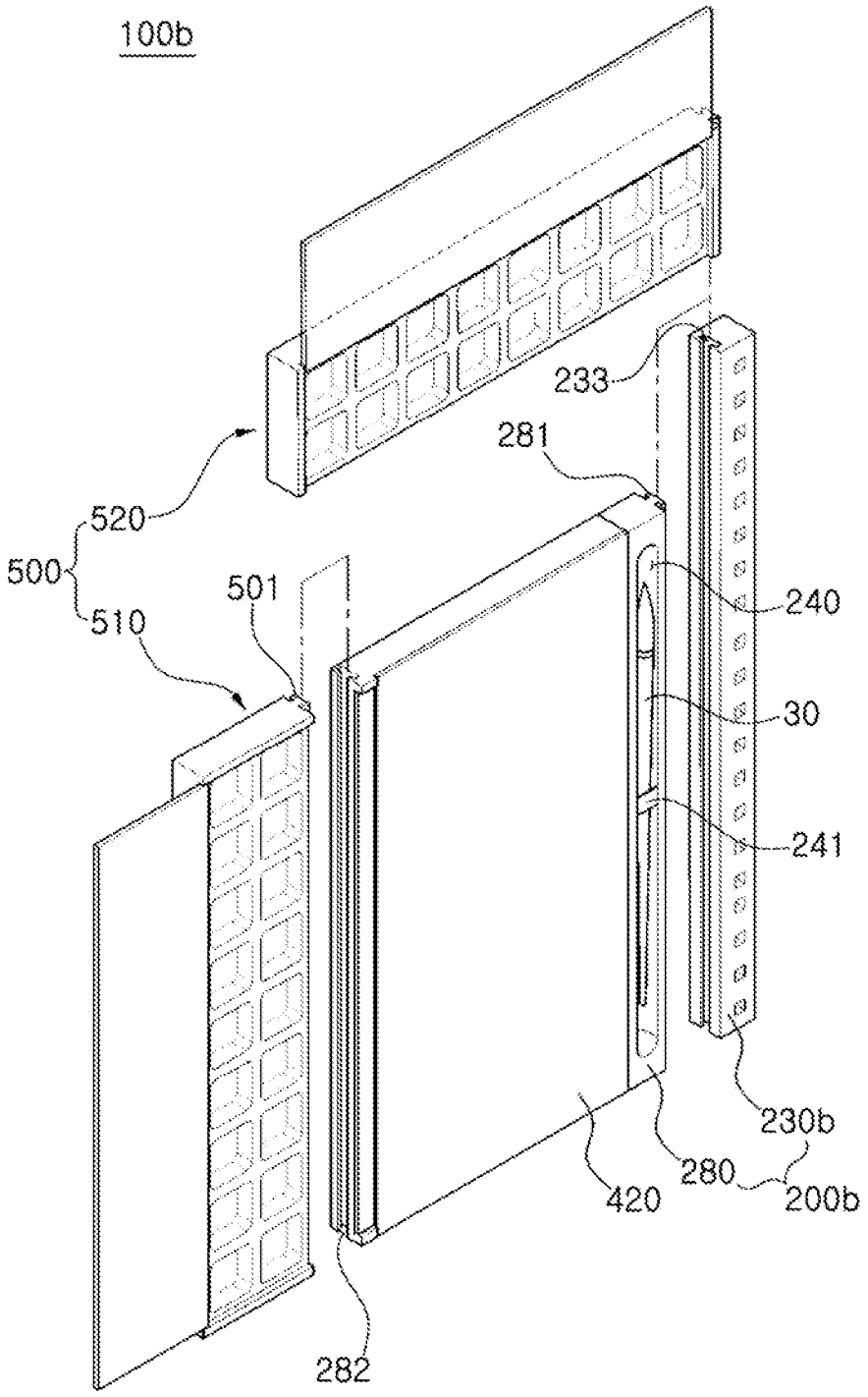

BINDER ADAPTED PALETTE

CROSS REFERENCE TO RELATED APPLICATIONS

This application is a National Stage of International Application No. PCT/KR2020/007394 filed Jun. 8, 2020, claiming priority based on Korean Patent Application No. 10-2019-0095009 filed Aug. 5, 2019 and Korean Patent Application No. 10-2020-0068511 filed Jun. 5, 2020, the entire disclosures of which are incorporated herein by reference.

TECHNICAL FIELD

The present invention relates to a palette, and more specifically, to a binder adapted palette that is easily attached to or detached from a diary or notebook binder and is thus easily kept and carried together with the binder.

BACKGROUND ART

A palette is a painting tool used to release and mix paints in drawing watercolor or oil paintings. When drawing a picture, a user draws the picture with a brush on a paper using various tools such as the palette, paints, and a water bottle. Various tools are needed to complete a picture.

For example, it is necessary to prepare paints of various colors, a brush for painting with the paints, a palette used to mix paints of various colors with each other, paper on which a picture is drawn, etc. Without any one of those materials, it may be difficult to draw an intended picture.

Recently, more and more people travel abroad to draw a picture of beautiful places. Accordingly, more and more people are looking for a drawing tool that is simple and has increased convenience.

However, many tools are needed to paint watercolor or oil paintings rather than simple sketches. Thus, it is inconvenient to carry them all while traveling.

Further, conventional portable paint palettes are provided only as separate products from a binder such as a sketchbook. Thus, there is a need for a palette with increased portability and convenience.

DETAILED DESCRIPTION OF THE INVENTION

Technical Problem

Therefore, the present invention has been made in view of the above problems, and it is an object of the present invention to provide a binder adapted palette configured to be attachable to or detachable from a binder.

It is another object of the present invention to provide a binder adapted palette that is easy to carry and clean.

Technical Solution

In order to achieve the above objects, the present invention provides a binder adapted palette comprising: a body having a palette accommodation groove defined in a top surface thereof and a plurality of through-holes defined and arranged along one edge thereof, wherein the plurality of through-holes receive a binder ring of the binder; a palette detachably inserted into the palette accommodation groove; and a cover coupled to a top of the body to open and close the palette.

According to another feature of the present invention, the palette includes a plurality of space portions partitioned therein, and a plurality of paint containers removably inserted into the plurality of space portions, respectively.

According to another feature of the present invention, the device further comprises a plurality of supports, wherein each support is formed at one side of each space portion to elastically support a top of one side of each paint container.

According to another feature of the present invention, the cover includes: a first cover having one side hinge-coupled to a top of the body and pivoting in a first direction; and a second cover having one side hinge-coupled to the top of the body and pivoting in a second direction.

According to another feature of the present invention, the body includes: a receiver having the palette accommodation groove defined therein; and a binder portion coupled to one side of the receiver, wherein the through-holes are defined in a top surface of the binder portion.

According to another feature of the present invention, an opening and closing portion for opening and closing the palette accommodation groove is coupled to a front surface of the receiver, and is slidably coupled to the receiver.

According to another feature of the present invention, the palette includes: a plurality of partitioning walls respectively defining a plurality of space portions in the palette; a plurality of paint containers respectively inserted into the space portions; and each stopper protruding on a top of each partitioning wall to support a top of each paint container.

In order to achieve the above purposes, the present invention provides a binder adapted palette comprising: a body having a plurality of paint receiving spaces partitioned in a top surface thereof, and a plurality of through-holes defined and arranged along one edge thereof, wherein the plurality of through-holes receive a binder ring of the binder; and a cover coupled to a top of the body to open and close the paint receiving spaces.

According to one feature of the present invention, the body includes: a palette portion having the paint receiving spaces defined therein; and a binder portion coupled to one side of the palette portion, wherein the through-holes are defined in a top surface of the binder portion.

According to another feature of the present invention, the device further comprises a palette block detachably coupled to one side of the body.

Effect of the Invention

According to a binder adapted palette according to the present invention, the binder and the palette may be integrated with each other, thereby increasing portability and user convenience.

Further, according to the binder adapted palette according to the present invention, the paint container may be firmly coupled to the palette, and replacement of the paint container may be facilitated.

Further, according to the binder adapted palette according to the present invention, the palette may be separated from the body. Accordingly, maintenance including cleaning of the body and the palette may be facilitated.

Further, according to the binder adapted palette according to the present invention, the cover is firmly coupled to the body. Accordingly, the paint may be prevented from leaking out when the palette is being moved.

Further, according to the binder adapted palette according to the present invention, an additional palette block may be coupled according to the size of the binder, thereby allowing the palette to be used in various ways regardless of the binder size.

BRIEF DESCRIPTION OF DRAWINGS

FIG. 1 is a perspective view of a binder adapted palette according to a first embodiment of the present invention.

FIG. 2 is an exploded perspective view of FIG. 1.

FIG. 3 and FIG. 4 are diagrams of a use state of the binder adapted palette according to the first embodiment of the present invention.

FIG. 5 is an exploded perspective view of a binder adapted palette according to a second embodiment of the present invention.

FIG. 6 is a diagram of a use state of a binder adapted palette according to the second embodiment of the present invention.

FIG. 7 is a perspective view of a binder adapted palette according to a third embodiment of the present invention.

FIG. 8 is a diagram of a use state of a binder adapted palette according to a third embodiment of the present invention.

FIG. 9 is a perspective view of a binder adapted palette having a palette block coupled thereto.

FIG. 10 is an exploded perspective view of FIG. 9.

BEST EMBODIMENT OF THE INVENTION

Hereinafter, embodiments of the present invention will be described in detail with reference to the accompanying drawings. However, the embodiments described below are merely for explaining in detail enough that one of ordinary skill in the art to which the present invention pertains can easily practice the invention, which does not mean that the protection scope of the present invention is limited. In describing various embodiments of the present invention, the same reference numerals will be used for components having the same technical characteristics.

First Embodiment

FIG. 1 is a perspective view of a binder adapted palette according to a first embodiment of the present invention, and FIG. 2 is an exploded perspective view of FIG. 1.

As shown in FIG. 1 and FIG. 2, a binder adapted palette 100 according to the first embodiment of the present invention includes a body 200 in which the palette accommodation groove 210 is formed, and a palette 300 received in the palette accommodation groove 210 of the body 200, and a cover 400 that opens and closes the palette 300.

Each of the body 200, the palette 300, and the cover 400 may be made of synthetic resin or metal, or may be made of another material such as wood, if necessary. Further, all of the body 200, the palette 300 and cover 400 may be made of the same material, or at least one thereof may be made of a different material.

The body 200 accommodates therein the palette 300 and is be coupled to a binder ring 20 (see FIG. 4). Thus, the body 20 together with the binder 10 (see FIG. 4) serves to carry the palette 300.

In one example, the body 200 may be formed in a form of a hexahedral block as shown in FIG. 1 and FIG. 2. However, this is only one embodiment of the present invention. An overall outer shape of the body 200 may have various forms as needed.

The palette accommodation groove 210 for accommodating the palette 300 therein is formed in a top surface of the body 200. A step 220 is formed along an edge of the palette accommodation groove 210, and this step 220 serves to support the cover 400, which will be described later. The step 220 also serves to provide a space so that the cover 400 does not protrude upwardly beyond the top surface of the body 200. That is, when the palette accommodation groove 210 is screened by closing the cover 400, a top surface of the cover 400 may be coplanar with the top surface of the body 200 or may be positioned at a slightly lower level than that of the top surface of the body 200.

At least one first gripping cut 211 is formed at one side of the palette accommodation groove 210 so that a user may easily grip and separate the palette 300 accommodated in the palette accommodation groove 210. For example, as shown in the drawing, a pair of first gripping cuts 211 may be respectively formed at both ends in a longitudinal direction of the palette accommodation groove 210. In this regard, a gripping protrusion 301 is formed on an outer side surface of the palette 300, which will be described later, to face each of the first gripping cuts 211. The user may hook a finger under the gripping protrusion 301 through the first gripping cut 211 and may lift up the palette 300 from the palette accommodation groove 210.

A plurality of through-holes 231 is formed along one edge of the top surface of the body 200 on one side of the palette accommodation groove 210 and is spaced apart from each other by a predetermined distance. For example, a binder portion 230 having a predetermined thickness may protrude outwardly and extend along one edge of the top surface of the body 200. The plurality of through-holes 231 may be formed in the binder portion 230. The binder ring 20 may pass through the through-holes 231. A shape, a size and the spacing of the through-holes 231 may be selected according to the type of the binder 10. In one example, an auxiliary storage portion 240 for keeping painting tools such as a coloring brush 30 or pencils and pens may be formed in a portion between the palette accommodation groove 210 and the through-holes 231.

The palette 300 is inserted into the palette accommodation groove 210. The palette accommodation groove 210 accommodates the palette 300. The palette 300 may be easily detached from the palette accommodation groove 210 when necessary. In order to prevent the palette 300 from being unexpectedly removed from the palette accommodation groove 210 when the binder adapted palette 100 is carried and moved, the palette 300 may be coupled to the palette accommodation groove 210 in a protrusion-groove coupling manner or press-fitting manner.

Thus, when the palette 300 is detachably coupled to the palette accommodation groove 210 of the body 200, the user may separate the palette 300 from the palette accommodation groove 210 when necessary, and may easily wipe off contaminants such as paints that have been deposited or remain on the palette accommodation groove 210 or wash the palette 300.

The palette 300 is formed in a box shape with an entirely open top, and a plurality of spaces 310 therein is partitioned. Each paint container 320 filled with a paint is detachably inserted into each space 310.

In one example, as shown in the drawing, a plurality of partitioning walls 330 spaced apart from each other by a predetermined interval in a width direction of the palette 300 may extend in a length direction thereof. Further, a support 340 is formed on one side of the partitioning wall 330 and is spaced apart from the partitioning wall 330 by a predetermined distance in the width direction of the palette 300. A plurality of the supports 340 may protrude upward from a bottom surface of the palette accommodation groove 210 and are spaced apart from each other by a predetermined distance and along the partitioning wall 330.

Each of the supports 340 serves to elastically support the paint container 320 accommodated in the space 310. A stopper 341 is formed on one side of a top of the support 340 and protrudes toward the paint container 320. The stopper 341 elastically supports a top of one side of the paint container 320 to prevent unexpected displacement of the paint container 320. That is, as shown in an enlarged view of FIG. 2, when the paint container 320 is inserted into the space 310, the support 340 is elastically deformed. When the paint container 320 is completely accommodated in the space 310, the stopper of the support 340 hooks the top of the paint container 320 and prevents the escape thereof.

In this regard, the paint container 320 may be formed in a form of a box having a width equal to a spacing between the partitioning wall 330 and the support 340. The paint container 320 may employ one available currently on the market.

The cover 400 is attached to the top of the body 200 to open and close the palette 300. This cover 400 usually covers a top of the palette 300 to prevent foreign substances from mixing with the paint. When the cover 400 is opened to use the palette 300, an inner surface of the cover 400 may be used as a color tone plate 401 used to mix paints with each other.

In one example, in an embodiment as shown in the drawing, a pair of covers 400 is pivotally coupled to the top of the body 200 to open and close the palette 300. However, this is merely an embodiment of the present invention. An installation location, the number, and a pivot direction of the covers 400 may be appropriately selected as needed.

According to this embodiment, one side of a first cover 410 is hinge-coupled to a left edge of the top surface of the body 200, and one side of a second cover 420 is hinge-coupled to a rear edge of the top surface of the body 200. The first cover 410 pivots in a left and right direction to open and close the palette 300, while the second cover 420 pivots in a front-back direction to open and close the palette 300. The second cover 420 covers the first cover 410 while being disposed on a top surface of the first cover 410. In addition, a coupling portion 421 is formed at a front end of the second cover 420 and protrudes downwards. When the second cover 420 is closed, an inner surface of the coupling portion 421 is coupled to a top surface of a front surface of the body 200 in a press fitting manner. A second gripping cut 422 is formed at the center of a lower end of the coupling portion 421 such that the second cover 420 coupled to the body 200 may be easily opened.

FIGS. 3 and 4 are views illustrating usage of the binder adapted palette according to the first embodiment of the present invention. FIG. 3 shows that the first cover 410 and the second cover 420 are pivoted outwardly to use the palette 300. In this case, a plurality of partitioning walls 402 protrude from an inner surface of each of the first cover 410 and the second cover 420 to define a plurality of color tone plates 401. The user may mix paints of desired colors with each other in each color tone plate 401.

FIG. 4 shows a state in which the binder adapted palette 100 according to an embodiment of the present invention is bound to the binder 10 such as a diary via the binder ring 20. According to the present invention, as shown in FIG. 4, painting tools such as the paint container 320, the palette 300 and the brush 30 may be integrally provided together with the binder 10. Thus, the user may carry a single integral body thereof.

Second Embodiment

FIG. 5 is an exploded perspective view of a binder adapted palette according to a second embodiment of the present invention.

A binder adapted palette 100*a* according to a second embodiment of the present invention has an overall configuration similar to that of the first embodiment as described above in that the former includes a body 200*a*, a palette 300*a*, and a cover 400. However, there is a difference therebetween in that the palette 300*a* is slidably coupled to the palette accommodation groove 210, the paint container 320 is slidably coupled to the palette 300*a*, and the body 200*a* includes a storage 250 and a binder portion 230*a* as detachably interconnected to each other.

Hereinafter, the same reference numerals will be given to the same components having the same functions as those of the above-described first embodiment, and redundant descriptions thereof will be omitted. The binder adapted palette according to the second embodiment of the present invention will be described based on the differences from the binder adapted palette according to the first embodiment of the present invention.

The body 200*a* according to the second embodiment of the present invention includes the storage 250 and the binder portion 230*a* that are removably coupled to each other. To this end, a plurality of first coupling protrusions 232 protrudes from one side surface of the binder portion 230*a*, and a plurality of first coupling grooves 251 to which the first coupling protrusions 232 are respectively coupled are formed on a surface of the storage 250 facing the binder portion 230*a*. Accordingly, if necessary, the user may easily separate the storage 250 from the binder portion 230*a* to replace the paint container 320 or wash the storage 250 and the palette 300*a*.

In this regard, the palette accommodation groove 210 is formed in the storage 250, and the auxiliary storage portion 240 and the through-holes 231 are formed in the binder portion 230*a*.

In one example, the palette 300*a* is attached to the palette accommodation groove 210 of the storage 250 in a sliding manner.

To this end, an opening and closing portion 260 for opening and closing the palette accommodation groove 210 is disposed on a front surface of the storage 250. One side of the opening and closing portion 260 is hinge-coupled to one side of the front surface of the storage 250, and a flange 261 protrudes from the other side of the opening and closing portion 260 and is coupled to a front end of a side wall of the storage 250. In this regard, a second coupling groove 252 is formed in the front end of the sidewall of the storage 250, and a second coupling protrusion 262 is formed to protrude from the flange 261 so as to be coupled to the second coupling groove 252.

After the opening and closing portion 260 is opened, the palette 300*a* may move from a location in front of the storage 250 and be slidably coupled to the palette accommodation groove 210. Therefore, according to the second embodiment of the present invention, it is not necessary to pivot the cover 400 to mount the palette 300*a*. Further, a stopper (not shown) for preventing the palette 300*a* from upwardly moving and being removed may protrude on a top of an inner wall of the palette accommodation groove 210.

In this regard, the palette 300 of the first embodiment as described above may be slidably coupled to the palette accommodation groove 210. In another example, as shown in FIG. 5, the palette 300*a* of the second embodiment into which each paint container 320 is slidably coupled may be slidably coupled to the palette accommodation groove 210.

The palette 300*a* according to the second embodiment of the present invention has a form of a box with an open front. A plurality of space portions 310 is partitioned inside the palette 300*a* via a plurality of partitioning walls 330*a* spaced apart from each other in a width direction. In this regard, a front surface of each space portion 310 is open, and the paint container 320 may move from a location in front of the palette 300*a* and be slidably coupled to each space portion 310. In order to prevent upward movement and displacement of the paint container 320 slidably coupled thereto in this way, a stopper 331 is formed on a top of the partitioning wall 330*a* so as to protrude toward the space portion 310 and thus support a top of the paint container 320.

After the opening and closing portion 260 is opened, the paint container 320 may move from a location in front of the palette 300*a* and be slidably coupled to each space portion 310. Thus, according to the second embodiment of the present invention, it is not necessary to pivot the cover 400 to mount the paint container 320.

A plurality of covers 400 is coupled to a top of the body 200*a* so as to open and close the palette 300*a*. For example, as shown in the figure, one side of a first cover 410 that is opened and closed while pivoting in the left and right direction may be hinge-coupled to one edge of a top surface of the body 200*a*. A rear end of the second cover 420 that is opened and closed while pivoting in the front-rear direction may be hinge-coupled to a rea edge of the top surface of the body 200*a*. Further, the second cover 420 may be opened and closed to cover a top of the first cover 410.

In this regard, a height of the palette 300*a* is slightly smaller than that of the binder portion 230*a* such that when the palette 300*a* is covered with the first cover 410 and the second cover 420, a top surface of the second cover 420 does not protrude upwardly beyond a top of the binder portion 230*a*. For example, when the first cover 410 and the second cover 420 are closed, the top surface of the second cover 420 is preferably coplanar with the top surface of the binder portion 230*a* or positioned at a slightly lower level than that of the top surface of the binder portion 230*a*.

FIG. 6 is a view of usage of the binder adapted palette 100*a* according to the second embodiment of the present invention, and shows a use state of the palette 300*a* when the first cover 410 and the second cover 420 are opened. In this regard, the opening and closing portion 260 is coupled to a front end of the storage 250 to prevent frontward escape of the palette 300*a* and the paint container 320.

Third Embodiment

FIG. 7 is a perspective view of a binder adapted palette according to a third embodiment of the present invention, and FIG. 8 is a diagram of a use state of a binder adapted palette according to the third embodiment of the present invention.

A binder adapted palette 100*b* according to the third embodiment of the present invention is similar to the above-described embodiment in that the former includes a body 200*b* and the cover 400 and is integrally coupled to the binder 10 via the binder ring 20. However, the former has differences from the above-described embodiment in that the body 200*b* and the palette are integrally formed with each other, and a palette portion 280 and a binder portion 230*b* are slidably-coupled to each other.

Hereinafter, the same reference numerals are given to the same components having the same functions as in the above-described embodiment, and duplicate descriptions thereof are omitted. The binder adapted palette 100*b* according to the third embodiment of the present invention will be described based on the differences from the above-described embodiment.

The binder adapted palette 100*b* according to the third embodiment of the present invention has the body 200*b* in which a plurality of paint receiving spaces 270 are partitioned in a top surface thereof and a plurality of through-holes 231 for receiving the binder ring 20 are formed along one edge thereof, and the cover 400 that is attached to a top of the body 200*b*.

In this regard, the body 200*b* includes a palette portion 280 in which the plurality of paint receiving spaces 270 are partitioned in a top surface thereof, and a binder portion 230*b* coupled to one side of the palette portion 280 and having the plurality of through-holes 231 defined in a top surface thereof for receiving the binder ring 20.

The palette portion 280 and the binder portion 230*b* may be slidably coupled to or removed from each other. For example, as shown in the drawing, a slide groove 233 is formed in one surface of the binder portion 230*b*, and a slide protrusion 281 correspondingly coupled to the slide groove 233 may protrude from a surface of the palette portion 280 facing the binder portion 230*b*. In this case, there is an advantage that the palette portion 280 may be easily separated from the binder portion 230*b* when the device is not in use or when the device is washed.

The auxiliary storage portion 240 is formed in one side of a top surface of the palette portion 280, and accommodates therein painting tools such as a coloring brush 30. A fixing member 241 for preventing escape of the stored painting tools therein is installed at one side of the auxiliary storage portion 240. In one example, the fixing member 241 may be composed of a rubber band for preventing the escape. In another example, the fixing member 241 may be composed of an elastic clip that is installed inside a central portion of the auxiliary storage portion 240 to pressurize and support the painting tool while the drawing tool is received to prevent the drawing tool from being removed. In one example, the fixing member 241 in this embodiment may also be applied to the binder adapted palettes 100 and 100*a* of the first and second embodiments as described above.

A plurality of covers 400 is coupled to the top of the body 200*b* to open and close the paint receiving space 270. For example, as shown in the figure, one side of the first cover 410 that is opened and closed while pivoting in the left and right direction may be hinge-coupled to one edge of the top surface of the body 200*b*. A rear end of the second cover 420 which is opened and closed while pivoting in the front-rear direction may be hinge-coupled to a rear edge of the top surface of the body 200*b*. Further, the second cover 420 may be opened and closed to cover a top of the first cover 410.

In this regard, a height of the palette portion 280 may be slightly smaller than a height of the binder portion 230*b* such that when the first cover 410 and the second cover 420 cover the paint receiving space 270, a top surface of the second cover 420 does not protrude upwardly beyond the binder portion 230*b*. For example, when the first cover 410 and the second cover 420 are closed, the top surface of the second cover 420 is preferably coplanar with the top surface of the binder portion 230*b* or is positioned at a slightly lower level than that thereof.

Further, a sealing portion 430 is formed to protrude along edges and inner surfaces of the first cover 410 and the second cover 420 to prevent the paint from leaking from the paint receiving space 270 when the first and second covers 410 and 420 are closed. Further, inner bottom surfaces of the first and second covers 410 and 420 may be used as color tone plates 401.

In one example, the binder adapted palettes 100 to 100*b* according to the present invention may have at least one palette block 500 added thereto as needed.

FIG. 9 is a perspective view of a binder adapted palette having a palette block added thereto, and FIG. 10 is an exploded perspective view of FIG. 9.

According to the present invention, the palette block 500 accommodating a plurality of paints or paint containers 320 therein may be coupled to one side of each of the bodies 200 to 200*b* in a slide manner.

The binder 10 such as a diary or a notebook generally has various sizes. However, when each of the binder adapted palettes 100 to 100*b* is bound to the binder 10 having a size larger or smaller than each of the bodies 200 to 200*b*, each of the bodies 200 to 200*b* protrudes outwardly beyond the binder 10 or there is an empty space, which causes inconvenience in use.

According to the present invention, additionally coupling the palette block 500 on one side of each of the bodies 200 to 200*b* may allow expanding an overall size of each of the binder adapted palettes 100 to 100*b*. Removing the additionally coupled palette block 500 therefrom may allow reducing an overall size of each of the binder adapted palettes 100 to 100*b*.

For example, as shown in the drawing, a first palette block 510 may be slidably coupled to one side (a side in a vertical direction) of the body 200*b*, and a second palette block 520 may be slidably coupled to on another side (a side in a horizontal direction) of the body 200*b*.

In this regard, the palette block 500 may be formed in the same structure as those of the body 200*b* and the cover 400 of the third embodiment as described above, except for a size such as a width and a length thereof. A slide protrusion 501 protrudes from one surface of the palette block 500, and a slide groove 282 is formed in one surface of the body 200*b* such that the slide protrusion 501 of the palette block 500 is inserted into the groove.

In one example, in the embodiment shown in FIG. 9 and FIG. 10, an example in which the palette block 500 is additionally coupled to the binder adapted palette 100*b* according to the third embodiment is shown. In another example, the palette block 500 may be additionally coupled to each of the binder adapted palette 100 and 100*a* according to the first and second embodiments as described above.

In addition, the palette block 500 may be formed in a structure including each of the bodies 200 to 200*b*, each of the palettes 300 and 300*a*, and the cover 400 of the first to third embodiments.

For example, the palette block 500 may be additionally coupled to the binder adapted palette 100 according to the first embodiment, wherein the palette block 500 may be formed to include the body 200, the palette 300, and the cover 400 of the first embodiment. In another example, the palette block 500 may be additionally coupled to the binder adapted palette 100 according to the first embodiment, wherein the palette block 500 may be formed to include each of the bodies 200*a* and 200*b*, the palette 300*a* and the cover 400 of the second or third embodiment.

In another example, a pair of palette blocks 500 may be additionally coupled to the binder adapted palette 100 according to the first embodiment, wherein one palette block 500 may have the same structure as those of the body 200*a*, the palette 300*a*, and the cover 400 of the second embodiment, and the other palette block 500 may have the same structure as those of the body 200*b* and the cover 400 of the third embodiment.

That is, the palette block 500 having the same structure as those of each of the bodies 200 to 200*b*, each of the palettes 300 and 300*a*, and the cover 400 of the first to third embodiments may be additionally coupled to each of the binder adapted palettes 100 to 100*b* of the first to third embodiments.

Although the embodiments of the present invention have been described above, it is understood that those of ordinary skill in the art to which the present invention pertains may make various modifications without departing from the scope of the claims of the present invention.

INDUSTRIAL APPLICABILITY

According to the binder adapted palette according to the present invention, portability and ease of use of the palette are increased.

Further, according to the binder adapted palette according to the present invention, management, such as cleaning of the body and the palette is easy.

Further, according to the binder adapted palette according to the present invention, the palette block may be additionally coupled thereto according to a binder size.

The invention claimed is:

1. A binder adapted palette comprising:

a body having a palette accommodation groove defined in a top surface thereof and a plurality of through-holes defined and arranged along one edge thereof, wherein the plurality of through-holes receive a binder ring of the binder;

a palette detachably inserted into the palette accommodation groove; and a cover coupled to a top of the body to open and close the palette, wherein a step is formed along an edge of the palette accommodation groove of the body so as to support the cover, at least one first gripping cut is formed at one side of the palette accommodation groove, a gripping protrusion is formed on an outer side surface of the palette so as to face toward the first gripping cut, an auxiliary storage portion for keeping painting tools therein is formed in a portion between the palette accommodation groove and the through-hole, wherein the palette includes:

a plurality of space portions partitioned therein via a plurality of partitioning walls;

a plurality of paint containers removably inserted into the plurality of space portions, respectively; and a plurality of supports protruding upward from a bottom surface of the palette and are spaced apart from each other by a predetermined distance and along at least one of the plurality of partitioning walls, wherein a stopper is formed on a top of each of the supports so as to elastically support a top of one side of each paint container.

2. The binder adapted palette of claim 1, wherein the cover includes:

a first cover having one side hinge-coupled to the top of the body and pivoting in a first direction; and a second cover having one side hinge-coupled to the top of the body and pivoting in a second direction.

3. A binder adapted palette comprising:

a body having a palette accommodation groove defined in a top surface thereof and a plurality of through-holes defined and arranged along one edge thereof, wherein the plurality of through-holes receive a binder ring of the binder;

a palette detachably inserted into the palette accommodation groove; and a cover coupled to a top of the body to open and close the palette, wherein the body includes:

a storage portion having the palette accommodation groove defined therein; and a binder portion coupled to one side of the storage portion, wherein the through-holes and an auxiliary storage portion for keeping painting tools therein are defined in a top surface of the binder portion, wherein a plurality of first coupling protrusions protrudes from one side surface of the binder portion, and a plurality of first coupling grooves to which the first coupling protrusions are respectively coupled are formed on a surface of the storage portion facing toward the binder portion, wherein an opening and closing portion for opening and closing the palette accommodation groove is coupled to a front surface of the storage portion, and is slidably coupled to the storage portion, wherein one side of the opening and closing portion is hinge-coupled to one side of a front surface of the storage portion, a flange protrudes from the other side of the opening and closing portion and is coupled to a front end of a side wall of the storage portion, a second coupling groove is formed in the front end of the sidewall of the storage portion, and a second coupling protrusion is formed to protrude from the flange so as to be coupled to the second coupling groove, wherein the palette has a box form having an open front face and includes:

a plurality of partitioning walls respectively defining a plurality of space portions in the palette;

a plurality of paint containers respectively inserted into the space portions; and a stopper protruding on a top of each partitioning wall to support a top of each paint container, wherein a front surface of each space portion is open, and the paint container moves from a location in front of the palette and is slidably coupled to each space portion.

4. A binder adapted palette comprising:

a body having a plurality of paint receiving spaces partitioned in a top surface thereof, and a plurality of through-holes defined and arranged along one edge thereof, wherein the plurality of through-holes receive a binder ring of the binder; and a cover coupled to a top of the body to open and close the paint receiving spaces; and a palette block detachably coupled to one side of the body, wherein the body includes a palette portion having the paint receiving spaces defined therein, and a binder portion coupled to one side of the palette portion, wherein the through-holes are defined in a top surface of the binder portion, wherein a slide groove is formed in one surface of the binder portion, and a slide protrusion correspondingly coupled to the slide groove protrudes from a surface of the palette portion facing toward the binder portion, wherein an auxiliary storage portion is formed in one side of a top surface of the palette portion and accommodates therein painting tools, wherein a fixing member for preventing escape of the stored painting tools therein is installed at one side of the auxiliary storage portion, wherein the slide protrusion protrudes from one surface of the palette block, and the slide groove is formed in one surface of the body such that the slide protrusion of the palette block is inserted into the slide groove.

* * * * *